US006129503A

United States Patent [19]

Schenone

[11] Patent Number: 6,129,503

[45] Date of Patent: Oct. 10, 2000

[54] COMBINATION COUNTER-EJECTOR SHINGLE-OUTPUT DELIVERY SYSTEM

[75] Inventor: Michael A. Schenone, Garfield, N.J.

[73] Assignee: Bobst Group, Inc., Roseland, N.J.

[21] Appl. No.: 09/104,801

[22] Filed: Jun. 25, 1998

Related U.S. Application Data

[60] Provisional application No. 60/050,859, Jun. 26, 1997.

[51] Int. Cl.[7] ..... B65G 59/00

[52] U.S. Cl. ..... 414/788.1; 414/902; 414/794.4

[58] Field of Search ..... 414/922, 902, 414/788.1, 794.4, 789.9

[56] References Cited

U.S. PATENT DOCUMENTS

| | | | |
|---|---|---|---|
| 1,434,014 | 10/1922 | La Bombard . | |
| 3,122,230 | 2/1964 | Bogue . | |
| 3,730,515 | 5/1973 | Spiess . | |
| 4,652,197 | 3/1987 | Littleton . | |
| 4,658,961 | 4/1987 | Tamura . | |
| 4,784,558 | 11/1988 | Toriyama . | |
| 5,158,522 | 10/1992 | Cummings et al. | 493/370 |
| 5,396,752 | 3/1995 | Mastropasqua . | |
| 5,545,001 | 8/1996 | Capdeboscq . | |

OTHER PUBLICATIONS

Introduction to Flexo Folder Gluers Chapter 11 pp. 237–250, Jun. 25, 1998.

*Primary Examiner*—Gregory A. Morse
*Attorney, Agent, or Firm*—Allen N. Friedman; McCarter & English, LLP

[57] ABSTRACT

A system assembles and conveys a stream of plate-like workpieces from a production system, such as a specialty box folder-gluer, to a strapping or tying system, as counted stacks. The system can be converted from counter-ejector mode, automatically counting and assembling workpieces of approximately the same thickness at their leading and trailing edges into stacks as they emerge from the production system, to a standard conveyor system, delivering a shingled stream of workpieces that are thicker or thinner at the leading edge, to an assembly station for counting and stacking, either manually or automatically. The system is converted from one mode to the other to accommodate the particular characteristics of the workpieces being produced. In an exemplary embodiment, specific mechanical accommodations are provided in the system to permit this conversion and specific setup steps are taken to accomplish the

12 Claims, 5 Drawing Sheets

COMBINATION COUNTER-EJECTOR SHINGLE-OUTPUT DELIVERY SYSTEM

RELATED APPLICATIONS

This application claims priority based on Provisional Application No. 60/050,859, filed Jun. 26, 1997.

FEDERALLY SPONSORED RESEARCH

Not Applicable

BACKGROUND OF THE INVENTION

1. Field of the Invention

The invention is in the field of material handling and conveying systems.

2. Brief Description of the Background Art

Plate-like workpieces, such as sheets of cardboard or flat folded boxes are emitted from production machines, such as printers or folder-gluers. These articles are usually conveyed from the production machines, counted, stacked, and strapped for handling and shipment to the customer. There are two common methods of accomplishing these operations the shingle-output delivery system and the counter-ejector delivery system.

In a counter-ejector delivery system, such as disclosed in U.S. Pat. No. 5,545,001, issued Aug. 13, 1996 and incorporated herein by reference, the workpieces are counted and stacked as they emerge from the production machine and are ejected as a series of counted stacks onto a conveyor belt that carries the stacks to the work station, where they are strapped for shipment. The counter-ejector system is of particular applicability to workpieces that are of the same thickness at the leading and trailing edge. Such workpieces stack evenly.

In the cardboard box industry, there are a number of widely used box styles that only require side-to-side folds for the gluing needed before shipment as flat boxes. Such boxes include the standard RSC boxes and can be produced by standard folder-gluers, that only fold in the lateral direction, producing boxes that are the same thickness at their leading and trailing edges. Since the counter-ejector mechanism can be designed to operate with a very short cycle time and high through-put, the production rate limiter is usually the production machine and high speed RSC box production machines are usually supplied with counter-ejector delivery systems.

In the shingled-output system, the workpieces fall onto a conveyor belt as they emerge from the production machine. The belt velocity is such that as a workpiece falls onto the belt, its leading edge falls on the trailing edge of the preceding workpiece, producing an overlapping (shingled) stream of workpieces. The belt carries this stream of workpieces to a work station, where they are counted, stacked and strapped. This can be done manually or through a combination of manual and mechanized operations. The shingle-output system is of particular applicability to workpieces that differ in thickness between the leading and trailing edges. When stacked, such thickness differences accumulate, producing lopsided stacks. It is common to compensate for this thickness difference by reversing the orientation of half of each stack. This is usually a manual operation. However, mechanical methods of varying complexity for performing this finction have been developed (See, for example, U.S. Pat. No. 4,784,558, issued Nov. 15, 1988).

There are many box styles (See, for example, U.S. Pat. No. 4,658,961, issued Apr. 21, 1987) that require complex folding operations. The equipment used to fabricate such boxes is referred to as a specialty folder-gluer. Many such box styles in the folded state have a different number of cardboard thickness at the leading and trailing edge, usually requiring handling by a shingle-output delivery system. It is common, in the box industry, to provide specialty folder-gluers with shingle-output delivery systems. In these systems, the stacking and assembly operations described above are usually the limiting factor on the machine's production rate. However, some complex box styles produced by specialty folder-gluers are symmetric from front to back and could be handled by the faster counter-ejector system.

Thus, there is a need, particularly in the cardboard box industry, for a way to combine the production speed of the counter-ejector delivery system with a versatile production machine, such as the specialty folder-gluer.

SUMMARY OF THE INVENTION

The inventive device disclosed herein is a workpiece delivery system that is convertible between counter-ejector delivery mode and shingle-output delivery mode. The conversion method is also disclosed. Thus, a versatile production machine, such as a specialty folder-gluer that is capable of producing both symmetric and asymmetric workpieces can be operated at a production machine limited rate producing symmetric workpieces with its delivery system in the counter-ejector mode and at a delivery system limited rate producing asymmetric workpieces with its delivery system in the shingle-output delivery mode.

The disclosed system assembles and conveys a stream of plate-like workpieces from a production system, such as a specialty box folder-gluer, to a strapping or tying system, as counted stacks. The system can be converted from counter-ejector mode, automatically counting and assembling workpieces of approximately the same thickness at their leading and trailing edges into stacks as they emerge from the production system, to a standard conveyor system, delivering a shingled stream of workpieces that are thicker or thinner at the leading edge, to an assembly station for counting and stacking, either manually or automatically. The system is converted from one mode to the other to accommodate the particular characteristics of the workpieces being produced. In the disclosed exemplary system pecific mechanical accommodations are provided in the system to permit this conversion and specific setup steps are taken to accomplish the conversion.

The convertible delivery system is provided, in each of its sections, with upper compression belts to keep, for example, folded and glued boxes from unfolding before the glue has had a chance to set. The specialty folder gluers, that are contemplated here as a particularly advantageous object of the application of this invention, are capable of producing boxes with complex internal folds. Such boxes, when folded and glued, have a great deal of internal "memory" and will tend to unfold as the glue is setting unless a controlled amount of pressure is applied from the top as they are being conveyed and stacked.

In this convertible system, during conversion to shingle-output mode the stack elevator portion of the counter-ejector mechanism is repositioned so as not to interfere with translation of the delivery section's main frame to a position adjacent to the transfer section that transfers the boxes from the folder gluer into the delivery system. The entry of the delivery section is adapted for shingle-output operation by (a) raising the upper entry roller supporting the entry end of the upper compression belt to guide the workpieces into the delivery section and (b) lowering at least one set of rollers supporting the lower conveyor belt to provide a compliant section of lower belt that can accept the falling boxes, without bending them. During conversion, the worktable is repositioned to remove from service the work table conveyor belt that conducts stacks assembled in the counter ejector mechanism, to a strapping or tying device, and place in service a low friction working surface that will aid in the manual assembly of asymmetric boxes from a shingled stream. Low friction surfaces with forced air coming through the surface, providing an air cushion to aid the movement of boxes, are advantageously employed. Examples of these mechanisms are illustrated in the figures described below.

DETAILED DESCRIPTION OF THE INVENTION

Figure 1:
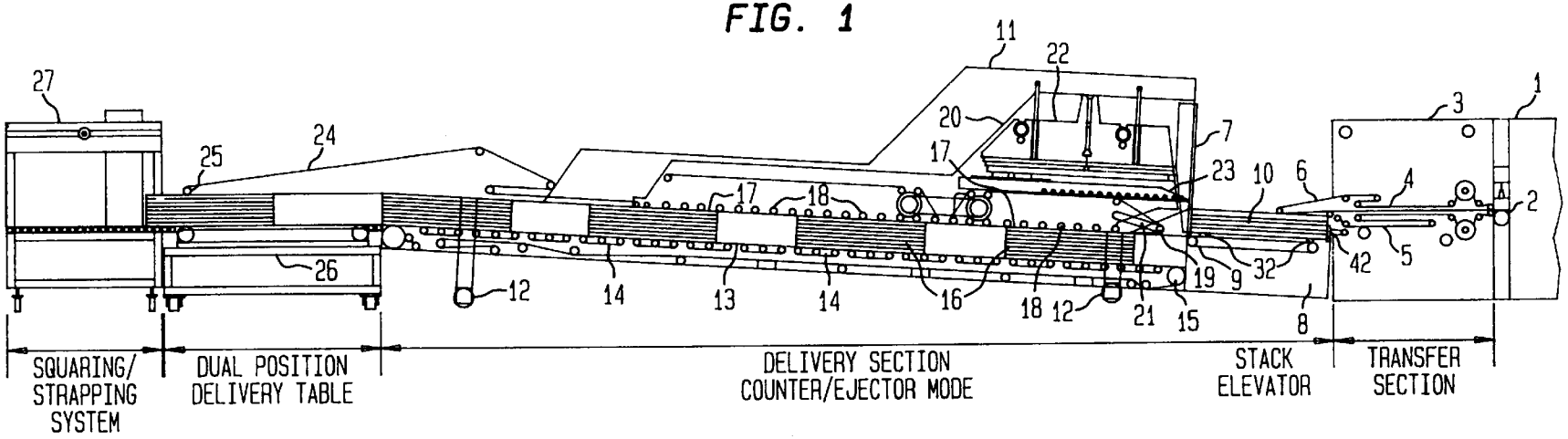
FIG. 1 is an elevational side view of an exemplary delivery apparatus in the counterejector delivery mode.
Figure 2:
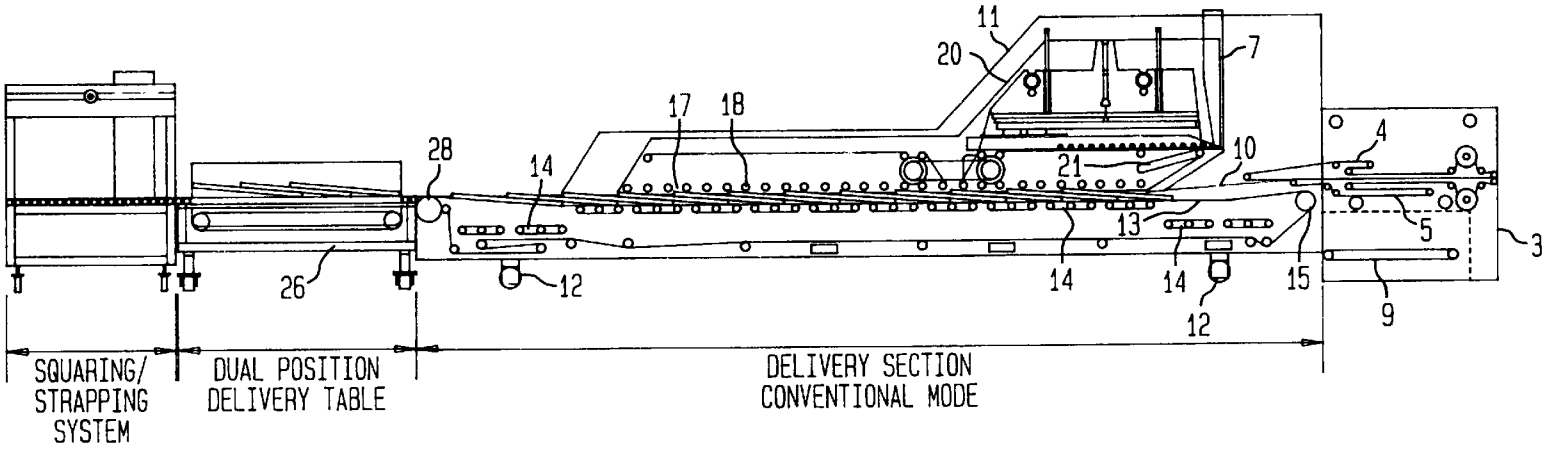
FIG. 2 is an elevated side view of an exemplary delivery apparatus in the shingle-output delivery mode.

The inventive combination counter-ejector shingle-output delivery system disclosed herein is illustrated in the counter-ejector mode in FIG. 1 and in the shingle output mode in FIG. 2. While delivering systems in various embodiments are known, the exemplary embodiments illustrated in FIGS. 1 and 2 contain novel kinds of structures for realizing each mode and novel kinds of elements that permit the conversion. However, the invention is not limited to the particular illustrated embodiments, the figures are schematic and the technology needed to realize the various components is well understood in the delivery systems industry. Many individual structural elements, disclosed in one form can be embodiment in other forms with equivalent operational results. For example, belt systems can be operationally equivalent to roller systems. Actuators can operate electrically or pneumatically. Mechanical systems can be direct-driven by electric motors or driven remotely through belts and pulleys and activated by electrically or mechanically operated clutches. In the figures some of the support structures are schematically represented, and some are not shown at all to permit a clearer view of the operational elements. Design of such structure is within the capabilities of a competent equipment designer.

FIG. 1 shows a delivery system of the invention in the counter-ejector mode. The exit end 1 of the production machine ejecting plate-like workpieces, such as folded boxes, into the delivery system terminates in a pressure roller assembly 2 that is pneumatically adjusted to compress the box folds. The workpieces enter the transfer section 3 containing upper and lower compression belts 4, 5 that move the workpieces forward, while maintaining them in compression to, for example, prevent unfolding of boxes. Preferably the upper and lower belts 4, 5 are arranged to be of the same length and driven by the same motor to prevent application of unwanted shear forces to the workpieces.

Figure 3C:
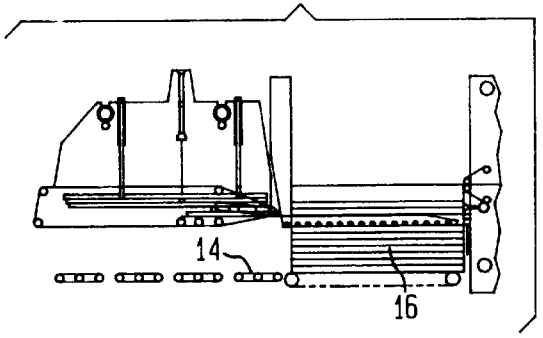
FIGS. 3(*a*)–(*f*) is a time sequence series of elevational side views of the stack elevator and interrupter assembly portion of the exemplary apparatus shown in FIG. 1, showing one cycle of counter-ejector operation.
Figure 3B:
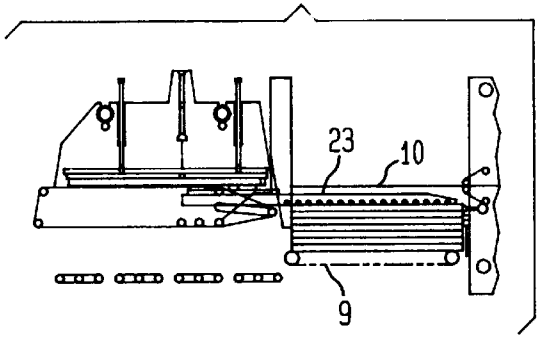
Figure 3A:
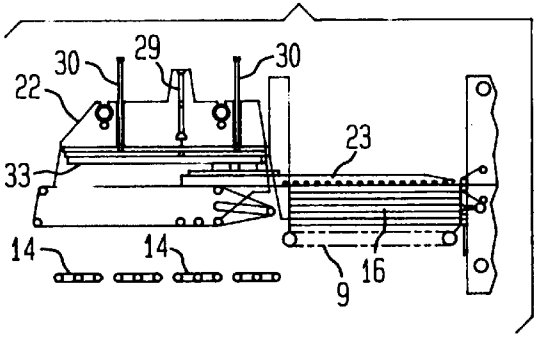
Figure 3F:
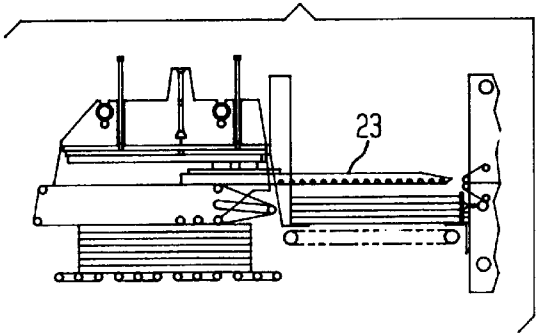
Figure 3E:
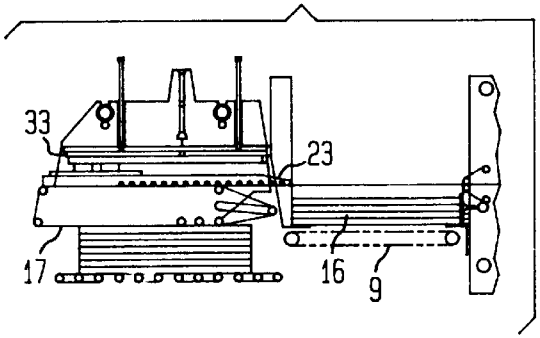
Figure 3D:
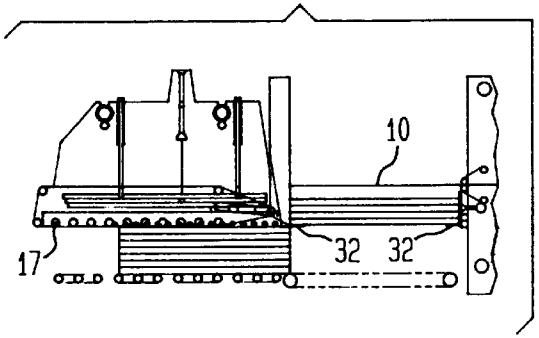

The upper belt 4 is supported such that its downstream end 6 ("downstream" means to the left in the direction away from the production machine 1.) extends into the next section—the stack elevator 8, in this mode. The end of this trombone extension 6 is mechanically biased (e.g., by means of springs) to maintain a downward pressure on the workpieces in the stack elevator 8 and a forward frictional force urging the workpieces 10 against the forward stop 7. A back jogger 42, a pneumatically actuated oscillating back plate, urges the boxes 10 against the front stop 7, in order to square them. The stack elevator 8, adjacent to the transfer section 3 receives the workpieces 10 as they are delivered and accumulates them in a stack on a powered stack conveyor 9, which can be a belt or a series of powered rollers. The stack elevator 8 includes means 43 for raising the conveyor 9 to a level near the pressure rollers 2 and lowering the conveyor 9 as the workpieces accumulate. (See FIG. 3*f*—shown schematically as a hydraulic cylinder.) When the desired number of workpieces is reached, the counted stack is ejected into the delivery section 11, to which the stack elevator is mounted.

The delivery section is supported by a main frame 11 that is mounted on wheels 12 or some other translation means to facilitate mode conversion and has a locking means, such as a lynch pin, for fixing its position for either operational mode. A delivery belt 13 is carried by lower support rollers 14. The lower support rollers 14 are supported by actuators 44, e.g., pneumatic actuators, for height adjustment. (See FIG. 3*f*.) In the counter-ejector mode, the upstream, entry end of the delivery section is height adjusted to so that the entry end roller 15 of the delivery belt 13 is at the stack elevator's 8 exit level.

As a counted stack 16 passes into the delivery section, it is held in compression between the delivery belt 13 and upper compression belts 17. These belts 17 are supported against the stacks 16 by a series of compression rollers 18. Those compression rollers 18 are supported by pneumatic actuators that are adjusted to cooperate with the lower belt support rollers 14 to maintain the stacks 16 in the desired level of compression. The upper compression belts are mounted on a subframe 20 that translates with respect to the main frame 11 to accommodate different box lengths. The entry end of the upper compression belt 17 is supported by entry roller 19. This roller is mounted on an adjustable support arm 21, which in the counter-ejector mode is lowered to maintain pressure and traction on the entering stack 16. An interrupter arm assembly 22 is also mounted on the subframe 20. The interrupter arm assembly 22 is provided with at least one, but preferably a plurality of interrupter arms 23. The interrupter arms are mounted so as to be capable of longitudinal extension and retraction and vertical motion. When an accumulating stack in the stack elevator 8 reaches the desired number of workpieces, the interrupter arms 23 are extended over the counted stack at a level below the exit level of the transfer section, so that subsequent workpieces fall on top of the interrupter arms 23. The interrupter arms 23 are lowered to maintain the stack in compression as the stack conveyor is lowered to the entry level of the delivery belt 13 at the level of the entry end roller 15. As the stack 16 is drawn onto the delivery section by the delivery belt 13, the interrupter arms move with it to keep it in compression. While the interrupter arms 23 keep the stack 16 in compression, they are provided with rollers so as not to interfere with translational forces exerted by the upper compression belt 17 and delivery belt 13. The cyclic operation of the interrupter arm assembly 22 is more fully illustrated in FIG. 3.

The upper compression belt 17 has a variably extendable section 24 extending over the next section, a dual position delivery table 26. The downstream end roller 25 of this section 24 is mechanically biased (e.g., spring biased) to keep the stack 16 in compression on the delivery table 26 until it enters a strapping system 27, where it is bundled for transportation. The delivery table 26 is positioned with its conveyor belt on top (See FIG. 6) to convey the stacks 16 to the strapping system 27.

FIG. 2 shows the delivery system in shingle-output delivery mode. Here the stack conveyor 9 has been lowered to a level below the delivery belt's entry end roller 15 and the delivery section main frame 11 translated, via the wheels 12, upstream to a position adjacent to the transfer section 3. Lowering of the stack conveyor 9 places it in a non-interfering position relative to translation of the main frame 11, translated upstream via the wheels 12 to a position adjacent to the transfer section 3 It could also be swung aside or otherwise placed in a noninterfering position. Among the other adjustments made to accomplish mode conversion is the lowering of the downstream end of the delivery section and raising of the entry end roller 15, the exit end roller 28 and the lower support rollers 14. However, at least one section of lower support rollers 14 at either end are lowered out of contact with the delivery belt 13 to provide the belt 13 with compliant entry and exit sections to prevent damage to the workpieces 10 as they fall onto the belt 13 from the transfer section 3 and move from the delivery section onto the delivery table 26. In addition, the subframe 20 is moved downstream relative to the main frame 11 and the adjustable support arm 21 raised so that the upper compression belt 17 forms a wider entry for the workpieces 10. The front stop 7 and interrupter arms 23 are placed in non5 interfering positions in this operating mode.

The speed of the delivery section belts 4, 5 and the delivery and upper compression belts 17, 23 are coordinated such that the downstream end of one workpiece 10 falls on the upstream end of the preceding workpiece 10, forming a shingled output. The lower support rollers 14 and upper compression rollers 18 are adjusted to maintain the workpieces in compression and, for example, prevent unfolding of boxes before their glue sets. This low friction surface aids the manual assembly of workpiece stacks for strapping in the strapping system 27.

FIG. 3 illustrates the operating cycle of the interrupter arm assembly 22. In FIG. 3*a* the interrupter arms 23 have been extended over a counted stack 16 of workpieces 10. In FIG. 3*b*, as the stack conveyor 9 is lowered the subsequent workpieces 10 rest on top of the interrupter arms 23. In FIG. 3*c*, the counted stack 16 has reached the level of the lower support rollers 14 that support the delivery belt (not shown—See FIG. 1). The stack conveyer is then started to impel the counted stack onto the delivery belt and the interrupter arms 23 are retracted with the stack 16 in order to maintain the stack 16 in compression. In FIG. 3*d*, compression of the stack 16 is maintained by the upper compression belts 17, that are also powered to move at the same rate as the delivery belt 13, so that the stack 16 does not experience unwanted shear forces. Before retraction of the interrupter arms 23, stack supports 32 are extended from the transfer section 3 and the front stop 7 in order to support the accumulating workpieces 10 until the stack conveyor 9 can be elevated to receive the next stack 16, as illustrated in FIG. 3*e*. FIG. 3*e* also shows the interrupter arms 23 raised again in position to extend over the next stack 16 when the desired count is reached. The support member 33 carrying the interrupter arms is supported by guide rods 30 and raised and lowered by actuator 29. FIG. 3*f* shows the interrupter arms extended at the start of the next cycle.

Figure 4:
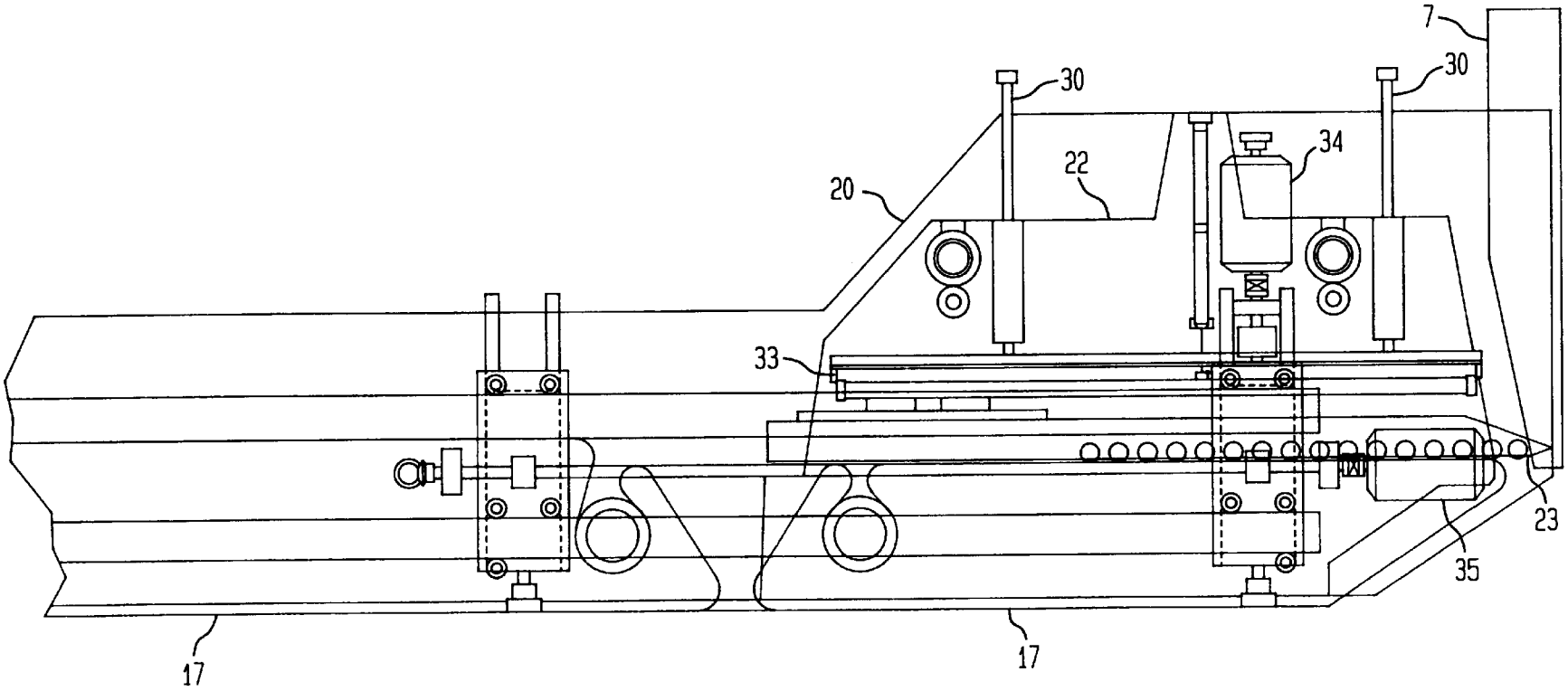
FIG. 4 is an elevational side view of an exemplary interrupter assembly showing more detail of some of the internal components.

FIG. 4 shows in more detail the structure of the interrupter arm support assembly 22. The interrupter arms 23 are supported by support member 33. Vertical and horizontal positioning of the interrupter arms 23 is controlled by actuating motors 34, 35 and guide rods 30. The position of the front stop 7 and upper compression belt 17 are indicated.

Figure 5:
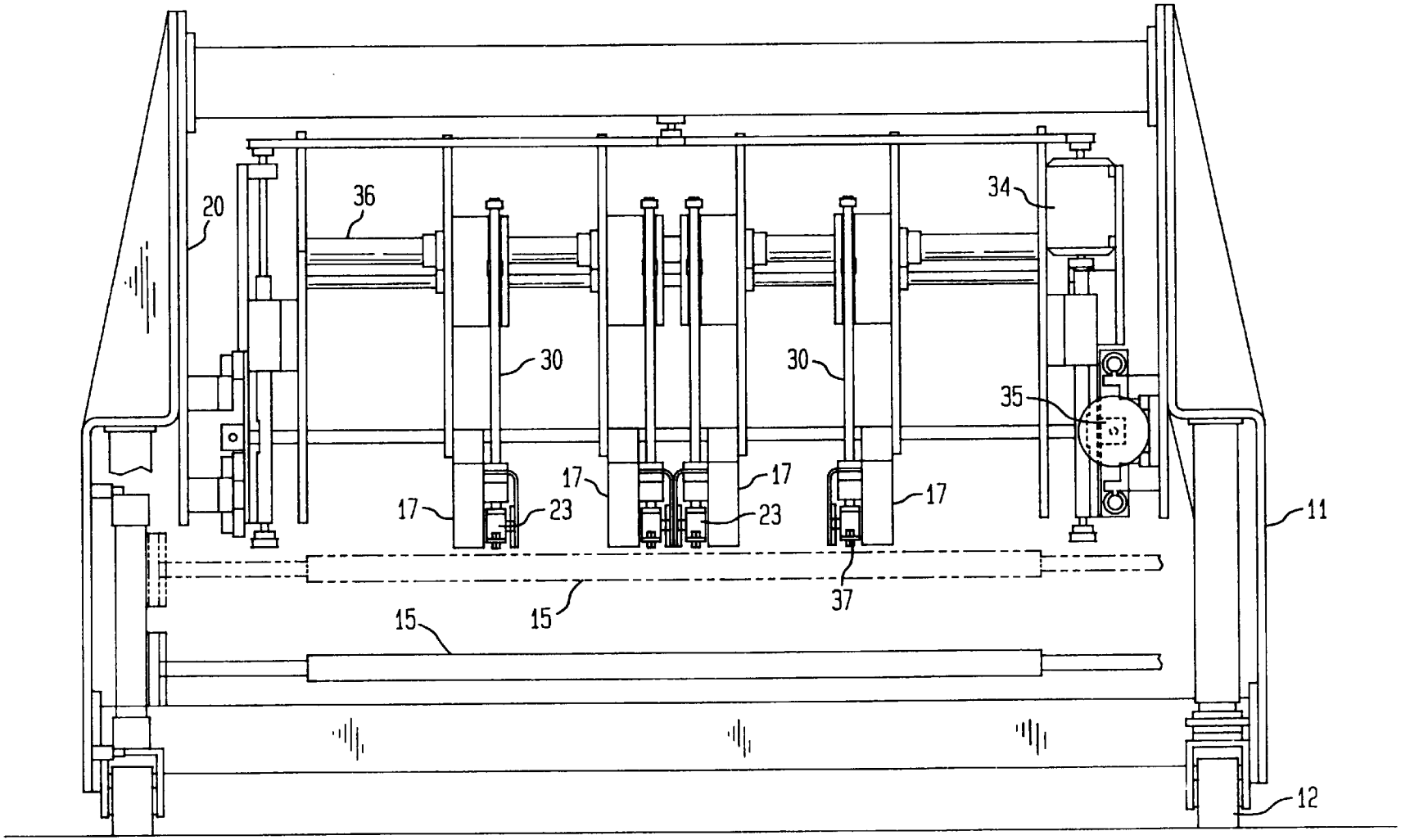
FIG. 5 is an elevational entry end view of the exemplary interrupter assembly as shown in FIG. 1, with the entry roller in FIG. 2 position shown in dashed lines.

FIG. 5 shows the entry view of the delivery section, illustrating the main frame 11 supporting the subframe 20 and being supported by wheels 12. The illustrated delivery section has four sets of upper compression belts 17 that can be independently laterally positioned along support rod 36 to accommodate workpieces of different shapes and sizes. The interrupter arms 23 with the interrupter arm rollers 37 ride up and down supported by guide rods 30. The delivery belt's entry end roller 15 is shown as solid lines in its lower counter-ejector mode position and in phantom in its raised shingled-stream mode position.

Figure 6:
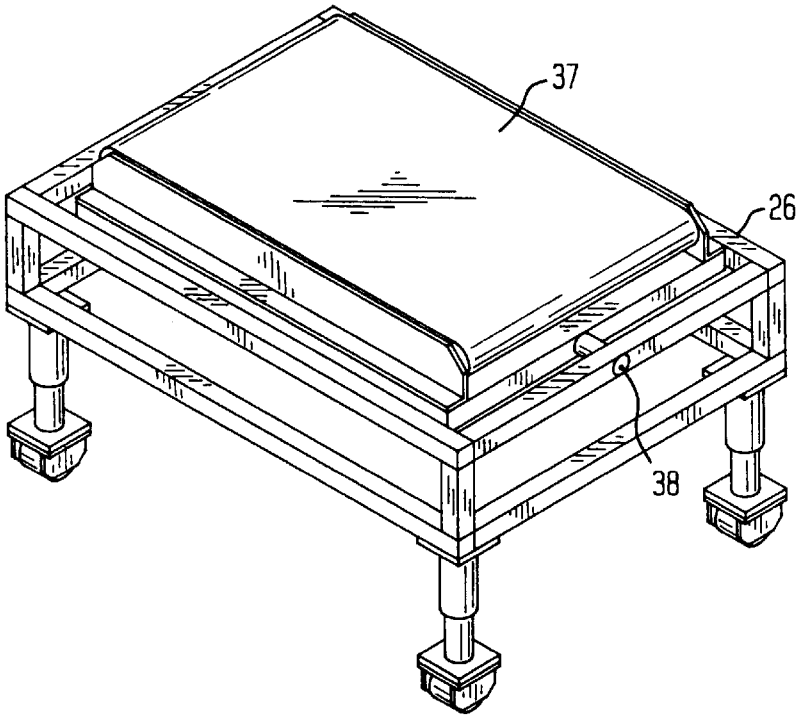
FIG. 6 is a perspective view of a delivery table with the counter-ejector conveyor surface in operating position.
Figure 7:
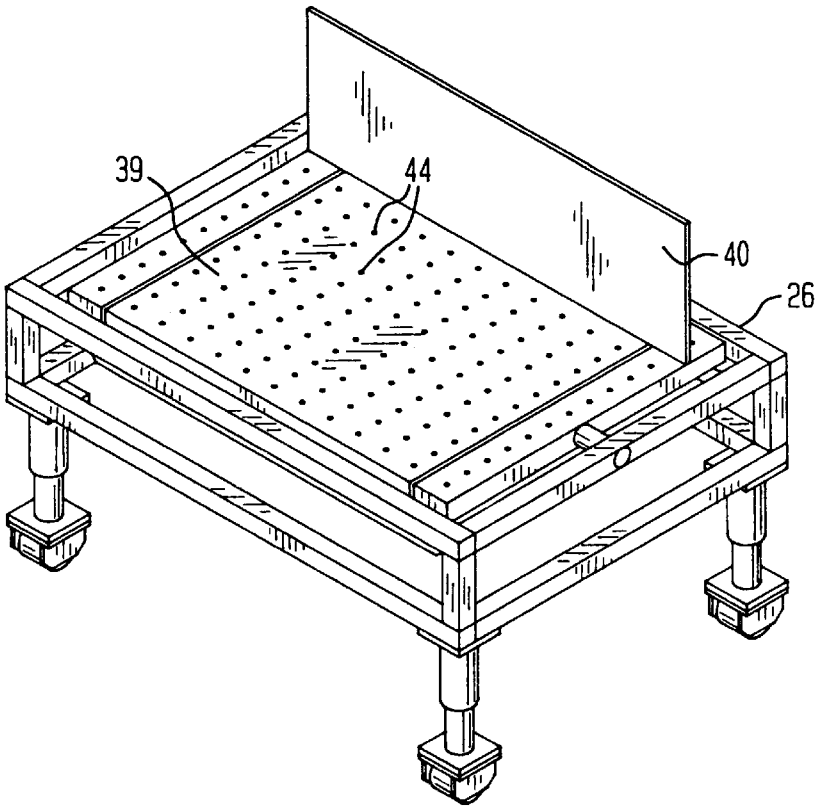
FIG. 7 is a perspective view of a delivery table with the shingle-output, low friction surface in operating position.

FIG. 6 shows the dual position delivery table 26 with the conveyor belt surface 37 in the upper position, for use in the counter-ejector mode. The table top can be pivoted around pivot 38 on an axis parallel to the surface, to bring the low friction surface 39 and assembly fence 40 to the upper position for use in the shingle-output mode, as illustrated in FIG. 7. The low friction surface 39, is shown with air vents 41 supplying an outflow of pressurized air, providing an air cushion to aid movement of workpieces across the surface 39. The assembly fence 40 aids the manual assembly of workpiece stacks. The low friction surface 39 can also be brought into position by lateral displacement.

What is claimed is:

1. A delivery apparatus for conveying a stream of workpieces from a production system to a strapping system, the delivery apparatus being adapted to convert between a counter-ejector delivery mode and a shingle-output delivery mode, the delivery apparatus comprising:

(a) a transfer section with an upper and a lower powered transfer belt adapted for transferring the workpieces from the production system downstream to a next operating section through a transfer exit, the upper belt including a forward, longitudinally adjustable and vertically loaded trombone section for maintaining the workpieces under both a downstream driving force and a vertical compressive force as the workpieces emerge from the transfer section and for at least a portion of their entry into the next operating section, and a retractable rear stack support for supporting the accumulating workpieces while a counted stack is being ejected in the counter-ejector mode;

(b) a stack elevator for accumulating counted stacks of a desired number of workpieces and successively discharging the stacks, the elevator including a powered stack conveyor and means for elevating the stack conveyor to an upper position adjacent to the transfer exit and lowering the stack conveyor as the workpieces accumulate and lowering the stack to the elevator's exit level when the stack has reached the desired number, and means for engaging the stack belt conveyor to eject the stack under downstream forces exerted by the stack conveyor and the upper transfer belt, which stack elevator is the next operating section in the counter-ejector delivery mode;

(c) means for retracting the stack elevator to a non-interfering position when converting from the counter-ejector delivery mode to the shingled-stream delivery mode and means for advancing the stack elevator into operating position when converting from the shingled-stream delivery mode to the counter-ejector delivery mode;

(d) a delivery section for conveying the workpieces to a dual position delivery table, comprising (i) a main frame including translation means for translating the delivery section to meet the transfer section when converting from the counter-ejector delivery mode to the shingled-stream delivery mode and fixing the delivery section in position, (ii) a powered delivery belt with an upper portion for carrying the workpieces downstream, the upper portion being supported by a plurality of a lower roller sections, (iii) at least one powered upper compression belt with a lower portion for carrying the workpieces downstream, the lower portion being supported by a plurality of upper roller sections and an entry roller rotably supported by an adjustable arm, (iv) compression means adjustably coupled to at least the plurality of upper roller sections or the plurality of lower roller sections, which compression means cause the delivery belt and the upper compression belt to cooperate in maintaining the workpieces in compression as they are being carried downstream, (v) means for rotating the adjustable arm from a lower position to an upper position when converting from the counter-ejector delivery mode to the shingled-stream delivery mode, (vi) means for lowering at least one of the lower roller sections at the delivery section's upstream end, out of contact with the delivery belt when converting from the counter-ejector delivery mode to the shingle-output delivery mode, (vii) a counter-ejector interrupter assembly for separating a counted stack of workpieces from the accumulating workpieces and exerting a compressive force on the counted stack as the counted stack is being ejected from the stack elevator, including at least one interrupter arm, means for extending the interrupter arm over the counted stack, lowering the interrupter arm to exert a compressive force on the counted stack, and retracting the interrupter arm as the counted stack is discharged, and (viii) a retractable front stack support for supporting the accumulating workpieces as the counted stack is being ejected in the counter-ejector mode, which delivery section is the next operating section in the shingle-output delivery mode; and (e) the dual position delivery table adjacent to the downstream end of the delivery section with a first working surface for use in the counter-ejector delivery mode and a second working surface for use in the shingle-output delivery mode, wherein the first working surface consists essentially of a powered table conveyor and the second working surface consists essentially of a fixed, low friction structure, and with means for repositioning the second working surface to the position of the first working surface when converting from the counter-ejector delivery mode to the shingle-output delivery mode.

2. The apparatus of claim 1 further including a variably extendable upper compression belt, extendable from the upper compression section downstream to the dual position delivery table's downstream end.

3. The apparatus of claim 1 in which the workpieces are folded and glued boxes.

4. The apparatus of claim 3 in which the transfer section includes a longitudinally oscillating back plate disposed so as to repeatedly jog the back edges of the accumulating boxes in order to square the boxes.

5. The apparatus of claim 1 in which the means for retracting the stack elevator includes means for lowering the stack conveyor below the elevator's exit level and below the level of the lower transfer belt, whereby the stack elevator is positioned below the transfer belts in the shingle-output delivery mode.

6. The apparatus of claim 1 in which the upper compression belt's position with respect to the main frame is longitudinally adjustable to accommodate different workpiece lengths.

7. The apparatus of claim 1 including means for lowering at least one of the lower roller sections at the delivery section's downstream end out of contact with the delivery belt when converting to the shingle-output mode.

8. The apparatus of claim 1 in which the second working surface of the dual position delivery table includes means for providing an air cushion to assist movement of the workpieces.

9. The apparatus of claim 1 in which the interrupter arms include rollers adapted to reduce frictional interference with the counted stacks of workpieces being ejected from the stack elevator.

10. The apparatus of claim 1 in which the means for repositioning the second working surface when converting to the shingle-output delivery mode comprises means for pivoting the second working surface about an axis parallel to the second working surface.

11. A delivery apparatus for conveying a stream of workpieces from a production system to a strapping system, the delivery apparatus being adapted to convert between a counter-ejector delivery mode and a shingled-stream delivery mode, the delivery apparatus comprising:

(a) a transfer section with upper and lower conveyor belts adapted for maintaining workpieces in compression, the upper conveyor belt including a forwardly extended and downwardly biased trombone section, and a retractable rear stack support;

(b) a stack elevator for accumulating a counted stack of workpieces in the counter-ejector delivery mode, including means for retracting to a non-interfering position in the shingled-stream delivery mode;

(c) a delivery section for conveying the workpieces, under compression to a delivery table, including means for translating the delivery section to a position adjacent to the transfer section in the shingle-output delivery mode, means for providing an unsupported lower conveyor belt entry section adjacent to the transfer section in the shingle-output delivery mode and means for supporting the entry section in the counter-ejector delivery mode, an adjustable roller support arm supporting an upper conveyor belt entry roller for supporting the upper conveyor belt's entry section in an upper position in the shingleoutput delivery mode and in a lower position in the counter-ejector delivery mode, a counter-ejector interrupter assembly with extendable and translatable interrupter arms for compressing the counted stack of workpieces, and a retractable front stack support to support accumulating workpieces as the counted stack is ejected from the stack elevator; and (d) a dual position delivery table with a conveyor belt surface for use in the counterejector delivery mode, a low friction surface for use in the shingle-output delivery mode, and means for repositioning the table surfaces when converting the delivery apparatus from one delivery mode to the other.

12. A method for converting a workpiece delivery system, with a transfer section, a stack elevator, a delivery section and a dual position work table, from a counter-ejector delivery mode to a shingle-output delivery mode comprising:

(a) retracting the stack elevator to a non-interfering position;

(b) translating the delivery section to a position adjacent to the transfer section;

(c) raising an adjustable entry roller arm at the delivery section's upper compression belt;

(d) lowering at least one lower conveyor belt support roller at the delivery section's entry; and (e) repositioning the dual position work table's surface to bring a low friction working surface adjacent to the delivery section's downstream end.

* * * * *